US005127166A

United States Patent [19]

Bishop

[11] Patent Number: 5,127,166

[45] Date of Patent: Jul. 7, 1992

[54] ROTATING CAP ADJUSTABLE BOW SIGHT

[76] Inventor: Ricky J. Bishop, 512 B Windsor Dr., Manchester, Ga. 31816

[21] Appl. No.: 665,081

[22] Filed: Mar. 6, 1991

[51] Int. Cl.[5] ..... F41G 1/00

[52] U.S. Cl. ..... 33/265; 33/233; 33/252

[58] Field of Search ..... 33/265, 251, 252, 254, 33/257, 233

[56] References Cited

U.S. PATENT DOCUMENTS

| | | | |
|---|---|---|---|
| 893,751 | 7/1908 | Putney | 33/251 |
| 2,770,041 | 11/1956 | Boll | 33/257 |
| 4,017,995 | 4/1977 | Hughes | 33/257 X |

*Primary Examiner*—Harry N. Haroian

[57] ABSTRACT

An adjustable sight for use on archery bows consisting of monofilament line which is threaded through a circular frame so as to form a diameter of said frame. This monofilament line, on which is attached an aiming point, slides inside a groove cut into the outside surface of the frame, halfway around, and is secured to both ends of a T-shaped piece. The top of the T-shaped piece rides in the groove and is flush with the outside of the frame. The protruding base of the piece fits into a small slot on the side of a separate circular rotating cap so that this rotating cap can be fitted over the front of the frame so as to cover the grooved portion. A rotation of this rotating cap causes the monofilament line to move, thereby moving the attached aiming point and providing a range adjustment. The speed and accuracy with which this adjustment can be made provides a definite advantage for the archer. The frame is movably mounted onto a bracket on the bow by two bolts protruding from the side of the frame such that the monofilament line is in the line of sight of the archer when he is in position to shoot and the horizontal distance between the frame and the bow can be adjusted, thereby varying the distance between the monofilament line and the bow and providing a sideways or windage adjustment in the sight.

6 Claims, 2 Drawing Sheets

ROTATING CAP ADJUSTABLE BOW SIGHT

BACKGROUND OF THE INVENTION

1. Field of the Invention

The present invention relates to a bow sight and, more particularly, to a bow sight which can be attached to a conventional bow frame above the handle and arrow rest and is adjustable both vertically and horizontally for range and windage, respectively.

2. Description of the Prior Art

Heretofore, there have been various bow sights having either beaded pins or crosshairs which are adjustable for both range and windage. It is the case, however, that most presently available sights have several rather delicate exposed movable parts which can be easily bumped out of adjustment by scraping the bow against brush or other foreign obstructions in the field. This can be disastrous to the archer who is depending on accuracy for a precise shot in the field or on a target range.

Other available bow sight mechanisms to which range adjustments can be made may require awkward time-consuming methods of adjustment due to the fact that the archer may have to first loosen and then relock the range locking mechanism. Furthermore, many such sights even require special tools to make these adjustments.

It is also the case that an archer may encounter difficulty in accurately viewing his target when shooting in low-light conditions. Available bow sights remedy this by offering electronically lighted aiming points. However, such electronically lighted aiming points are not accepted by current organizations recognizing trophy game animals taken with a bow.

A further case in point is that an arrow in flight from a bow tends to move transversely to its target, a movement known as windage. The amount of windage varies depending on environmental conditions and types of arrows used. Because of this, it will be advantageous to the archer if a windage adjustment can be made to accommodate different environmental conditions and different arrow types without disturbing any preset range adjustment. Otherwise, it would be necessary to reset the various range adjustments each time a windage adjustment is required. It is also beneficial if a single windage adjustment can be made for all target ranges simultaneously. This would save considerable time in making such adjustments.

Finally, it will also be advantageous to the archer to use a crosshair as the sighting means in a bow as this will allow him to quickly and sharply focus on his target.

This invention will serve to eliminate the aforementioned problems as well as providing the aforementioned advantages.

SUMMARY OF THE INVENTION

The bow sight constructed in accordance with the present invention is particularly designed to provide a bow sight which is strong, compact, easily and quickly adjustable for range, fully adjustable for windage without disturbing the range adjustment, and utilizes a circular flat light-gathering aiming point that will serve as a crosshair in sighting on a target.

The sight of this invention comprises a circular flat light-gathering aiming point attached to a monofilament line which is vertically threaded through the inner open portion of a circular frame and tied on the outer surface of the frame to a T-shaped piece riding in a groove cut into the outer surface of the frame. This T-shaped piece fits into and is concealed by a rotating cap that fits over the front of the frame. A windage reference is provided by the monofilament line within the inner open space of the frame, and a range reference is provided by the circular flat aiming point. The intersection of the flat aiming point and the monofilament line forms a crosshair within the frame. Rotation of the cap moves the monofilament line and adjusts the position of the circular flat light-gathering aiming point thereby allowing for a quick easily made range adjustment and allowing no exposure of delicate parts on the outside of the frame.

In a further embodiment of the sight, the circular frame is mounted on the bow in the line of sight of the archer so that the position of the frame assembly can be adjusted laterally in relation to the bow, thereby changing the position of the monofilament line in relation to the bow and providing a windage adjustment to the sight. The continuous nature of the monofilament line allows for a simultaneous windage adjustment of all ranges. It is further the case in this embodiment that the windage adjustment may be made without altering any preset range adjustment.

In still a further embodiment of the sight, the circular flat aiming point shall be made of a material that picks up stray ambivalent light so as to allow for fast, sure sighting without the use of electronically operated devices, even under low-level light conditions.

BRIEF DESCRIPTION OF THE DRAWINGS

The objects and advantages of the present invention will be more apparent and the invention more easily understood by reading the detailed description provided below when taken in conjunction with the attached drawings, wherein.

DETAILED DESCRIPTION OF A PREFERRED EMBODIMENT

Figure 1:
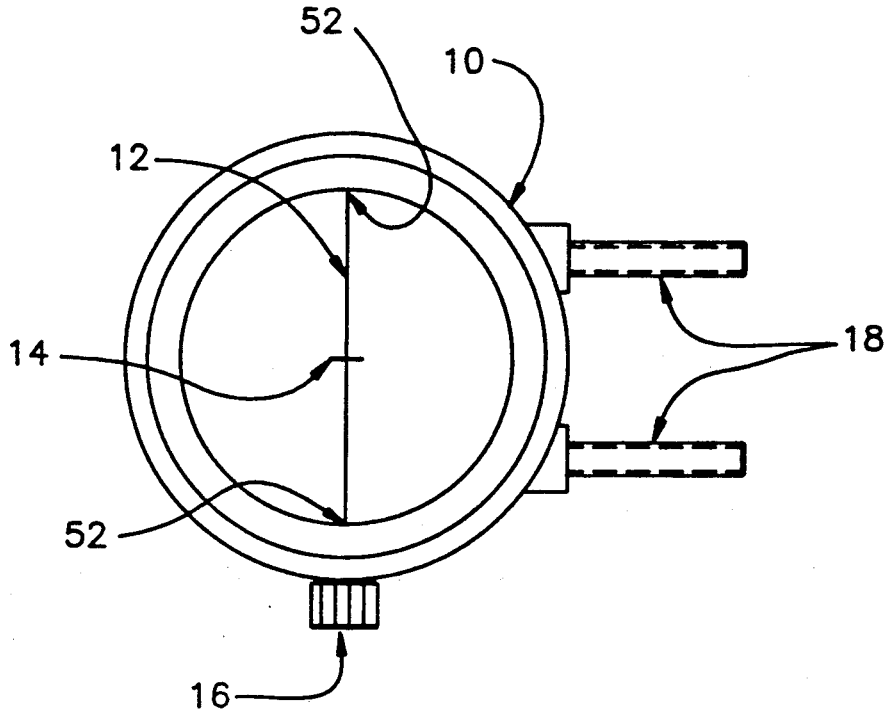
FIG. 1 is an end view of the bow sight formed in accordance with the principles of the present invention as seen by the archer in position to shoot.

Referring in more detail to FIG. 1, there is illustrated a bow sight, generally denoted as 10, as viewed head-on by the archer when in shooting position. The circular flat florescent light-gathering aiming point 14 is secured by an adhesive to a monofilament line 12. The aiming point 14 will be made of a material that picks up stray ambivalent light to aid in shooting in low-light conditions. Two threaded bolts 18 which are threaded into protrusions from the frame 30 are used to secure the sight 10 to the bow by first attaching the sight to some type of bracket which is then placed on the bow. Also shown in FIG. 1 is the knurled finger screw 16 which can be used to lock the aiming point 14 into the desired shooting position.

Figure 2:
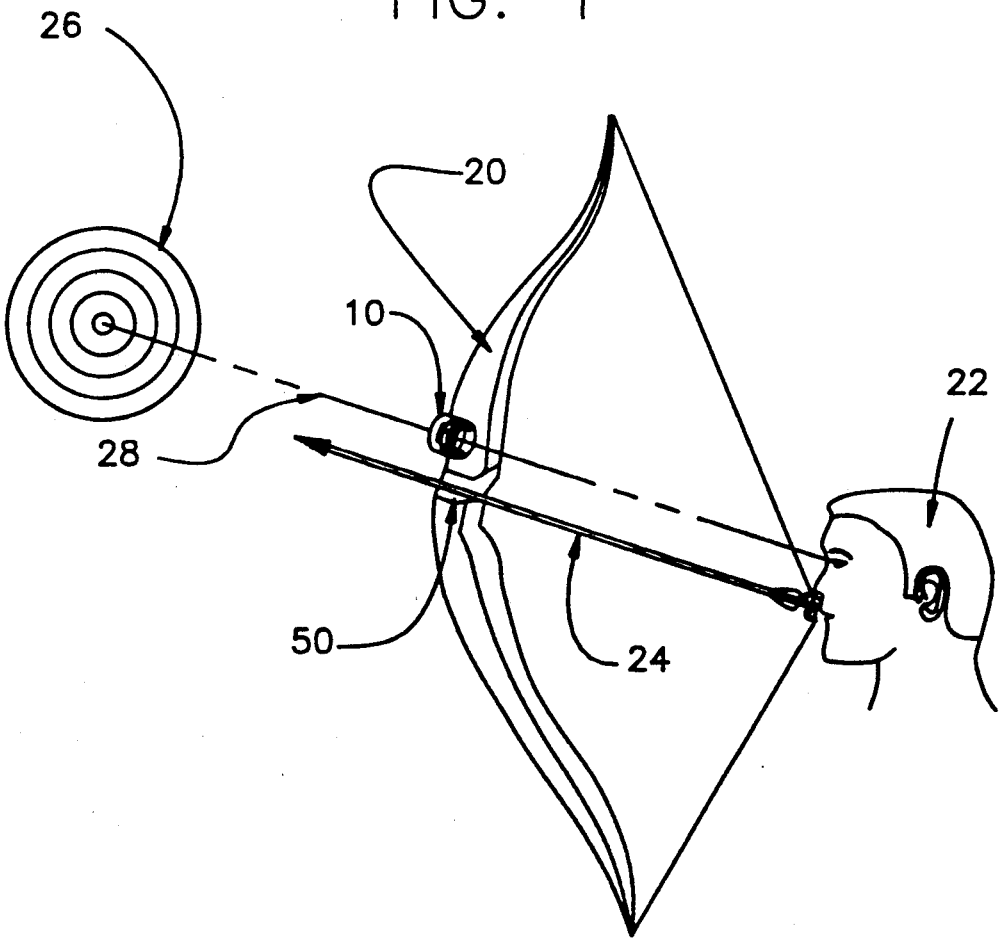
FIG. 2 is a pictorial view of the sight shown in FIG. 1 in use on a bow.
Figure 3:
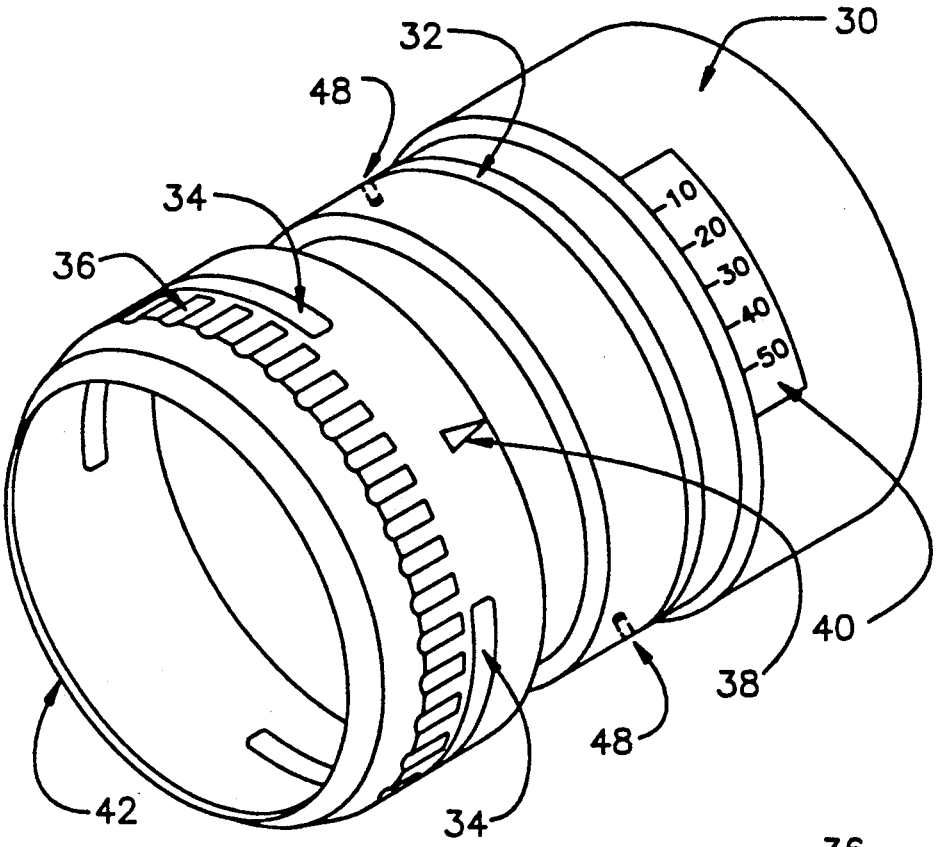
FIG. 3 is an isometric, slightly exploded side view of the sight of FIG. 1.

FIG. 2 shows the sight 10 made in accordance with the principles of this invention mounted on a bow 20. The sight 10 is located above an arrow rest 50 on the bow 20 a distance sufficient to allow the arrow 24 to pass beneath the bottom of the sight 10. In the case of a right-handed archer, the sight is secured by attachment to some type of bracket, to the right side of a bow 20, as viewed by an archer 22 holding the bow 20 in position to shoot. As viewed along the line of sight 28, the bow will appear interposed between the bracket and the sight 10. The sight 10 is forward of the bow 20, in other words, toward the target 26. For a left-handed archer, the sight 10 is inverted and fastened by attachment first to some type of bracket, to the left side of the bow 20.

Figure 4:
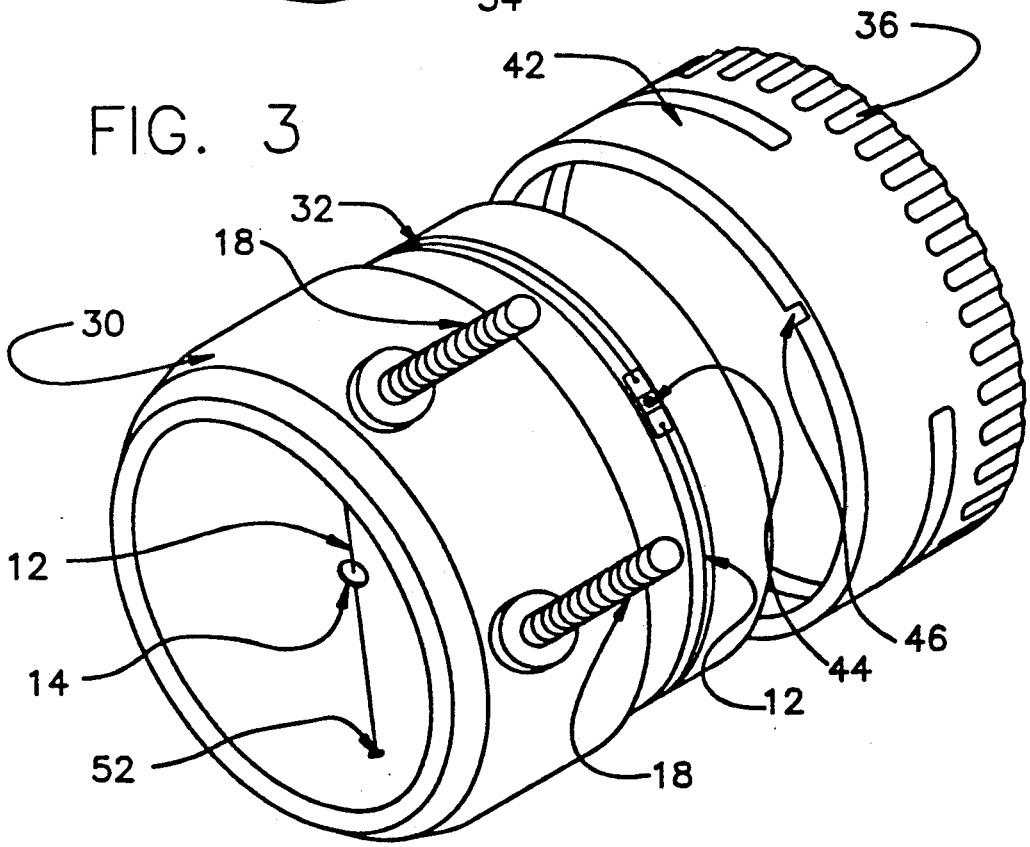
FIG. 4 is a view of the opposite side of FIG. 3.

In operation, the archer 22 places the circular flat flourescent light-gathering aiming point 14 in the line of sight 28 to a target 26. The circular flat aiming point 14 is visually placed on the target 26. The arrow 24 is released from the bow 20 towards the target 26. If the arrow misses the target because of an error in range, the archer can adjust the range of the sight by rotating the circular rotating cap 42 depicted in FIG. 4. The rotating cap 42 fits snugly over the front portion of the circular frame 30. A slot 46 cut into the outer edge of the circular rotating cap 42 so as to form a right angle with the edge of the circular rotating cap will accept and hold the protruding base portion of a T-shaped piece 44. The top portion of the T-shaped piece 44 fits snugly and rides inside a grooved slot 32 cut into the outer surface of the circular frame 30 and extending halfway around its outer circumference from top to bottom as the sight 10 is held in shooting position. Tied to each side of the top portion of the T-shaped piece 44 is each end of a piece of monofilament line 12. This monofilament line 12 also rides within the grooved slot 32 and enters the inside open circular area of the circular frame 30 by passing through two holes 52 (shown in FIG. 1) positioned directly opposite each other and at either end of the grooved slot 32 so that the monofilament line 12 forms a diameter within the inside open area of the circular frame 30. Onto the monofilament line 12, within the inside open area of the circular frame, is attached the circular flat flourescent light-gathering aiming point 14. The circular rotating cap 42 fits over the front outer surface of the circular frame 30 far enough to completely cover the grooved slot 32, and the protruding base portion of the T-shaped peice 44 fits into the slot 46 so that a rotation of the cap 42 moves the monofilament line 12 up or down thereby adjusting the position of the aiming point 14 to compensate for any error in range. The circular rotating cap 42 is held onto the circular frame 30 by two separate threaded screws 16 (shown in FIG. 1) which are inserted into each of two separate elongated slots 34 cut completely through and parallel to the edge of the rotating cap 42. The two separate threaded screws 16 are then threaded through two holes 48, respectively, located in the side wall of the circular frame directly opposite each other. In addition to keeping the rotating cap 42 held into place, the screws 16 and elongated slots 34 serve to regulate the rotational distance of the cap. Furthermore, at least one of these screws 16 will have a knurled head which can be tightened against the side of the rotating cap 42 to lock the circular aiming point 14 into a vertical position if so desired.

In use, when it is desirable to calibrate the sighting mechanism, normally the archer will travel to a target range and, from a predetermined distance, will visually place the circular aiming point 14 on the target and release the arrow. If the arrow misses the target, the archer will adjust the aiming point up or down by rotating the circular rotating cap 42 and continue this process until, by trial and error, the arrow hits the desired target. The outside surface of the rotating cap 42 will have a knurled ring 36 along its edge to allow for a better grip by the archer during adjustments. Next, the archer will mark this yardage on a marking tape 40 (attached to the outer surface of the frame 30) at a location directly opposite the pointer 38 (placed on the rotating cap 42). The positions of the marking tape and the pointer can be reversed while still remaining within the scope of the present invention. The archer will continue the described procedure at various distances until all desired shooting distances have been marked on the marking tape 40. If, in following this procedure, it is found that a windage adjustment needs to be made, the archer can do so by changing the lateral position of the sight 10 relative to the bow 20, thereby changing the relative position of the monofilament line 12 with respect to the bow 20.

If, after all desired markings have been placed on the marking tape 40 by the archer, the archer at some later date desires to shoot from a distance not precisely marked on the tape 40, he can extrapolate the range by setting the pointer 38 at a location between two adjacent markings on the marking tape 40.

Whereas, a preferred embodiment of the present invention has been described in relation to the drawings attached hereto, such description is for illustrative purposes only, and it should be noted that changes and modifications may be made without departing from the scope or spirits of the following claims.

What is claimed is:

1. An archery bow sight adapted for mounting on an archery bow for an aid in directing the longitudinal flight of an arrow and comprising:

a circular frame with an opened front and rear and having sufficient depth to accommodate at least one grooved slot cut into the outer surface of said frame with said at least one grooved slot extending at least halfway around the outer circumference of said circular frame starting at least at the top portion of said frame and ending at least at the bottom portion;

a monofilament line threaded through two holes which are located directly opposite each other in the wall of said circular frame, with said holes being located within aforementioned at least one grooved slot, said monofilament line having two loose ends which are secured to the top portion of a T-shaped piece, with the top portion of said T-shaped piece riding flush within the at least one grooved slot so that the threaded monofilament line forms a longitudinal diameter within the inner open portion of the circular frame;

at least one circular rotating cap fitting over the outer surface of said circular frame at least far enough so as to completely cover said at least one grooved slot, with said at least one circular rotating cap having one slot cut in its side wall so as to form a right angle with the edge of the said at least one circular rotating cap so that the slot will accept and hold the protruding base portion of the said T-shaped piece;

said monofilament line having an attached circular flat florescent light-gathering aiming point located within the open inner portion of the frame which serves as a crosshair when viewed head-on by the archer and can be adjusted vertically by rotating the at least one rotating cap;

a means for mounting said circular frame to some type of mounting device so that the said frame can be affixed to the bow, said means including two threaded bolts protruding from the outside wall of said circular frame.

2. An archery bow sight as set forth in claim 1 wherein said circular frame has two threaded holes located in its side wall, directly opposite each other over which is placed the said at least one circular rotating cap, with the said at least one circular rotating cap having two separate and distinct elongated slots in its side wall, said elongated slots being parallel to the edge of the said at least one rotating cap and aligned with the two said separate threaded holes in the said circular frame into each of which is inserted a threaded screw, with at least one said screw having a knurled head whereby tightening of the screw head against the side of said at least one rotating cap permits selective locking of said aiming point in the desired vertical position within the circular frame.

3. The sight of claim 1 further including means for varying the distance between the said circular frame and the mounting device.

4. An archery bow sight as set forth in claim 1 further comprising a marking means for recording yardage as determined by an archer, said marking means comprising:

(a) a pointer on an exterior surface of said circular frame; and (b) a markable exterior surface of said rotating cap onto which can be marked desired various yardages, with said markable exterior surface located directly opposite said pointer, so that when said rotating cap is rotated, said pointer will indicate desired yardage.

5. An archery bow sight as set forth in claim 1 further comprising a marking means for recording yardage as determined by an archer, said marking means comprising:

(a) a pointer on an exterior surface of said rotating cap; and (b) a markable exterior surface of said circular frame onto which can be marked desired various yardages, with said markable exterior surface located directly opposite said pointer, so that when said rotating cap is rotated, said pointer will indicate desired yardage.

6. An archery bow sight adapted for mounting on an archery bow for an aid in directing the longitudinal flight of an arrow and comprising:

a circular frame with an opened front and rear and having sufficient depth to accommodate at least one grooved slot cut into its outer circumference with said at least one grooved slot starting at least at the top portion of said frame and ending at least at the bottom portion;

a line threaded through two holes in the wall of said circular frame, with said holes located within aforementioned at least one grooved slot, said line having two loose ends which are secured to a top portion of a shaped piece riding flush within the at least one grooved slot so that the threaded line forms a longitudinal diameter within the inner open portion of said circular frame;

at least one circular rotating cap fitting over the outer surface of said circular frame at least far enough so as to completely cover said at least one grooved slot, with said at least one circular rotating cap having one slot cut in its side wall so as to form a right angle with the edge of said at least one circular rotating cap so that the slot will accept and hold a protruding base portion of said shaped piece;

said line having an attached aiming point located within the open inner portion of the frame which serves as a crosshair when viewed head-on by the archer and can be adjusted vertically by rotating the at least one rotating cap;

a means for mounting said circular frame to some type of mounting device so that the said frame can be affixed to the bow.

* * * * *